United States Patent [19]

Percy

[11] Patent Number: 5,046,474

[45] Date of Patent: Sep. 10, 1991

[54] CRANKCASE VENTILATOR/EVACUATION SYSTEM

[76] Inventor: Donald W. Percy, Pillsbury Rd., Southview Condo 9, Londonderry, N.H. 03053

[21] Appl. No.: 519,095

[22] Filed: May 4, 1990

[51] Int. Cl.[5] ..... F02M 25/00

[52] U.S. Cl. ..... 123/573; 123/572

[58] Field of Search ..... 123/572, 573, 574

[56] References Cited

U.S. PATENT DOCUMENTS

| | | | |
|---|---|---|---|
| 3,509,967 | 5/1970 | Ballard | 123/573 |
| 3,875,916 | 4/1975 | Patton | 123/573 |
| 4,256,064 | 3/1981 | Thorn | 123/572 |
| 4,453,525 | 6/1984 | Debruler | 123/573 |
| 4,459,966 | 7/1984 | Sakano et al. | 123/573 |
| 4,627,406 | 12/1986 | Namiki et al. | 123/573 |

*Primary Examiner*—Andrew M. Dolinar
*Assistant Examiner*—M. Macy
*Attorney, Agent, or Firm*—Ross, Ross & Flavin

[57] ABSTRACT

A crankcase fumes treatment apparatus envisions a primary filtering system for extracting fuel, moisture and solids from the engine crankcase, the solids being mainly trapped by a filter element preventing reentry into the engine, with the fuel vapors and moisture being conducted returnably to the engine for increasing horsepower and a secondary filtering system for secondarily filtering the fuel vapors from solids before passage to the engine.

1 Claim, 2 Drawing Sheets

CRANKCASE VENTILATOR/EVACUATION SYSTEM

BACKGROUND OF THE INVENTION

This invention relates to new and useful improvements in a ventilation system for the crankcase of an internal combustion engine.

1. Field of the Invention

Blow-by gases and vapors, such as moisture in the form of steam, hydrocarbons, and unburned fuel, enter the crankcase lubricating oil chamber during IC. engine operation, the gases and vapors occuring because of leakages past the piston rings during operation cycles.

If not removed as fast as they are introduced into the crankcase, contamination of the lubrication oil ensues. This condition has existed since the first IC engine was put into service.

Lubricants are formulated with an additive package for the purpose of suspending and emulsifying extraneous particles picked up from the atmosphere and blow-by vapors, plus gums, varnishes, tars, and acids generated by the combustion process.

Ventilating or scavenging crankcase systems in the past have attempted to provide a method for removing these undesirable particles into the atmosphere by a pressure method.

In normal operation of a reciprocating I.C. engine there is a certain amount of crankcase vapors, continually being developed. These consist in part of gaseous combustion products entering the crankcase by passing between the piston rings and cylinder walls, valve guides and valve stems. This particular portion of the crankcase vapors is often referred to as blow-by.

The crankcase vapors are normally comprised of, fuel, moisture hydrocarbons, soot combustible materials such as atomized oil, diesel fuel, and heavy particulate resulting from engine operation.

The releasing of such vapors and gases into ambient atmosphere is directly related to the development of a smog atmosphere. Obviously, the development of a means for reducing air pollution due to engine operation is a desideratum.

2. Description of the Prior Art

Numerous devices are known to the prior art which function to remove crankcase vapors and the like from the crankcase and pass same into the air carburetor and filtering system or intake manifold thereof unfiltered. For the most part, these crankcase vapors handling devices use a pushing or self-developed pressure method to release the vapors from the crankcase into the intake manifold without filtering or treating same, which my system does.

Thus, by so doing impregnating the lubricant with contaminates is eliminated, oil usage is prolonged, and less consumption is accomplished.

Some systems have been provided by establishing communication between the crankcase interior and the vacuum process now existing in the engine intake manifold. These systems, however, are plagued with the problem of adequate volumetric control of the undesirable vapors, solids and so on, under all conditions of the engine operation.

An apparatus for treating crankcase vapors is now known of which provides for directly removing the crankcase vapors from the crankcase into the intake manifold of the engine. While it removes the crankcase vapors from the engine, it does not substantially increase the hydrocarbon exhaust pollution due to the crankcase vapors being passed through the engine combustion system because of a depth packed filtering processing system before being introduced to the atmosphere.

Another known apparatus utilizes an indirect exhaust manifold heat exchanger to warm the vapors before they are introduced into the engine intake. Such a heat exchanger is known in the prior art as having a low efficiency which only slightly warms the vapors before they are introduced into the engine. The process of warming crankcase vapors and introducing them directly into the engine intake does not make them more significantly suitable for combustion to pollute the atmosphere.

With a gas engine running at idling speed and minimum load conditions, the throttle valve of the carburetor is substantially closed and hence, develops a maximum vacuum downstream of the throttle valve. During such a phase of engine operation, there is a minimum of leakage of gases, vapors and solids into the crankcase chamber. Like the prior application, a diesel engine has little vacuum in the intake air system at idle, this being the necessity of the compressor in constant use as is the operation of the evaculator system.

This constantly keeps the presence of moisture and diesel vapors in the crankcase at a negative state, which in turn minimizes the dilution of the lubricant and significantly reduces oil consumption previously being pushed out of the breather tube in the form of vapors, and at the same time eliminating back pressure to the underside of the pistons, stabilizing the overall performance of the engine. One half pound PSI of constant crankcase back pressure is equal to 86# of drag at all the running time of engine.

In a gas application with the throttle moved to a loaded or more fully-opened position, the manifold vacuum pressure approaches atmosphere effective conditions. At the same time the amount of blow-by gases, vapors and solids emitted into the crankcase and related chambers is substantially increased.

Ergo the need for an efficient crankcase evaculating system capable of constantly: 1. volumetrically controlling the vacuum of the crankcase back pressure, 2. versus ambient atmospheric pressure, 3. intake manifold vacuum and 4. blown air pressure.

In the case of turbo-powered diesel engine power plants, when the engine is under full load the blower is pressurizing the air into the intake manifold. This is the substantial explanation of the difference between this process hereof and the known prior art—#1 In order to remove the so-called fumes from the crankcase ; #2 filtering them to a cleaner state of condition than originally used; #3 the compressor as is adopted in this process is to accommodate three requirements at the same time,that being:

1. evacuating the fumes from the crankcase
2. drawing them through an effective depth-type filtering system and
3. exceeding the air pressure that is being exerted in the intake manifold by the engine blower.

If such a condition is not maintained constantly, a back lash will take place on the evaculator process, that is why the metered pressure from the compressor into the intake manifold has to exceed that of the blower of the engine at all times, supplying additional air and clean atomized fuel to generate additional horse power.

The embodiment of the crankcase fumes treatment apparatus of the present invention envisions a dynamic depth-type filtering system which cleans fuel vapors, and moisture, also non-ferrous solids from the engine crankcase blow-by. The solids are trapped by the filter element which prevents them from reentry to the engine intake manifold in contrast to prior art 2. However, the fuel vapors contained in the blow-by are cleaned and reused by the engine to general horsepower. By extracting the solid contaminants, porous and nonporous particulate but reintroducing cleaned diesel vapors to engine, wear is reduced, horsepower is increased, and the useful life of crankcase lubricant is prolonged and consumption is reduced. Returning fuel vapors to the engine intake manifold increases engine horsepower performance and fuel efficiency dramatically.

The invention provides a crankcase fumes treatment apparatus having a crankcase vapors and solids trap communicably connected with an I.C. engine between the crankcase and the intake manifold which in use will pass the resulting vapors into the intake manifold of the connected engine.

The system offers suitable application in diesel-driven trucks, tractors and buses, diesel-driven marine vessels and industrial generators of all types. Such a system can be modified to work very satisfactorily on automotive applications.

SUMMARY OF THE INVENTION

The embodiment of the crankcase fumes treatment apparatus of the invention envisions a dynamic filtering system which cleans the fuel and the moisture and eliminates the solids from the engine crankcase blow-by. The solids are trapped by a filter system which prevents them from reentering the engine. However, fuel vapors contained in the blow-by are reused by the engine. By extracting the contaminants, such as ferrous particles, engine wear is reduced and the useful life of the crankcase oil is prolonged. Returning the fuel vapors to the engine manifold dramatically increases engine horsepower, performance and fuel efficiency.

The invention provides a crankcase fumes treatment apparatus having a crankcase vapors trap communicably connected with an I.C. engine between the crankcase and the intake manifold which in use will pass crankcase vapors into the crankcase vapors trap and therein separate liquid portions thereof from gaseous portions thereof and pass the resulting vapors into the intake manifold of the connected engine.

The system offers suitable applications in diesel-driven trucks, tractors and buses, diesel-driven marine vessels and industrial diesel generators of all types.

DESCRIPTION OF THE PREFERRED EMBODIMENT

Figure 1:
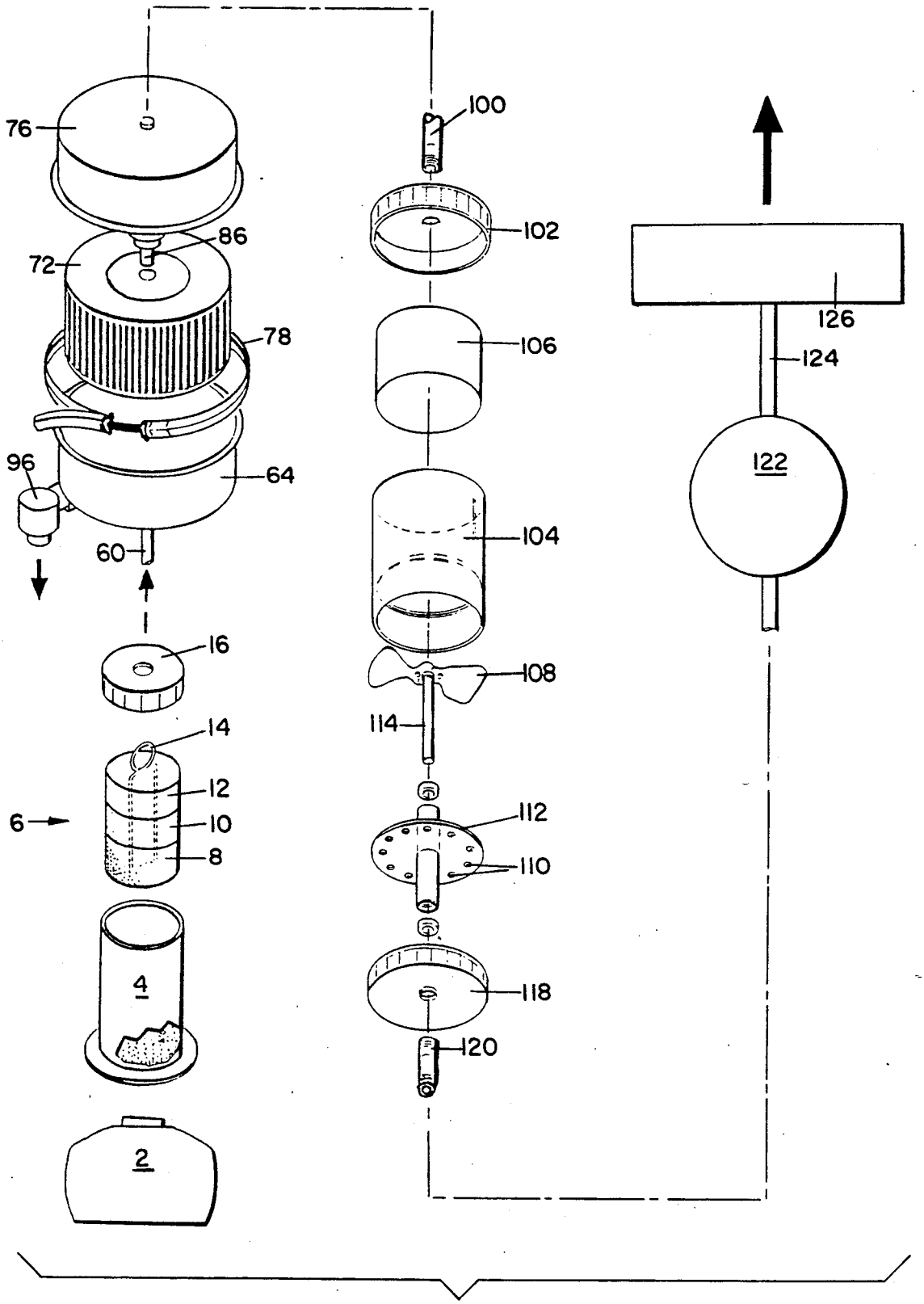
FIG. 1 is an exploded schematic diagram showing the key components of the system.
Figure 2:
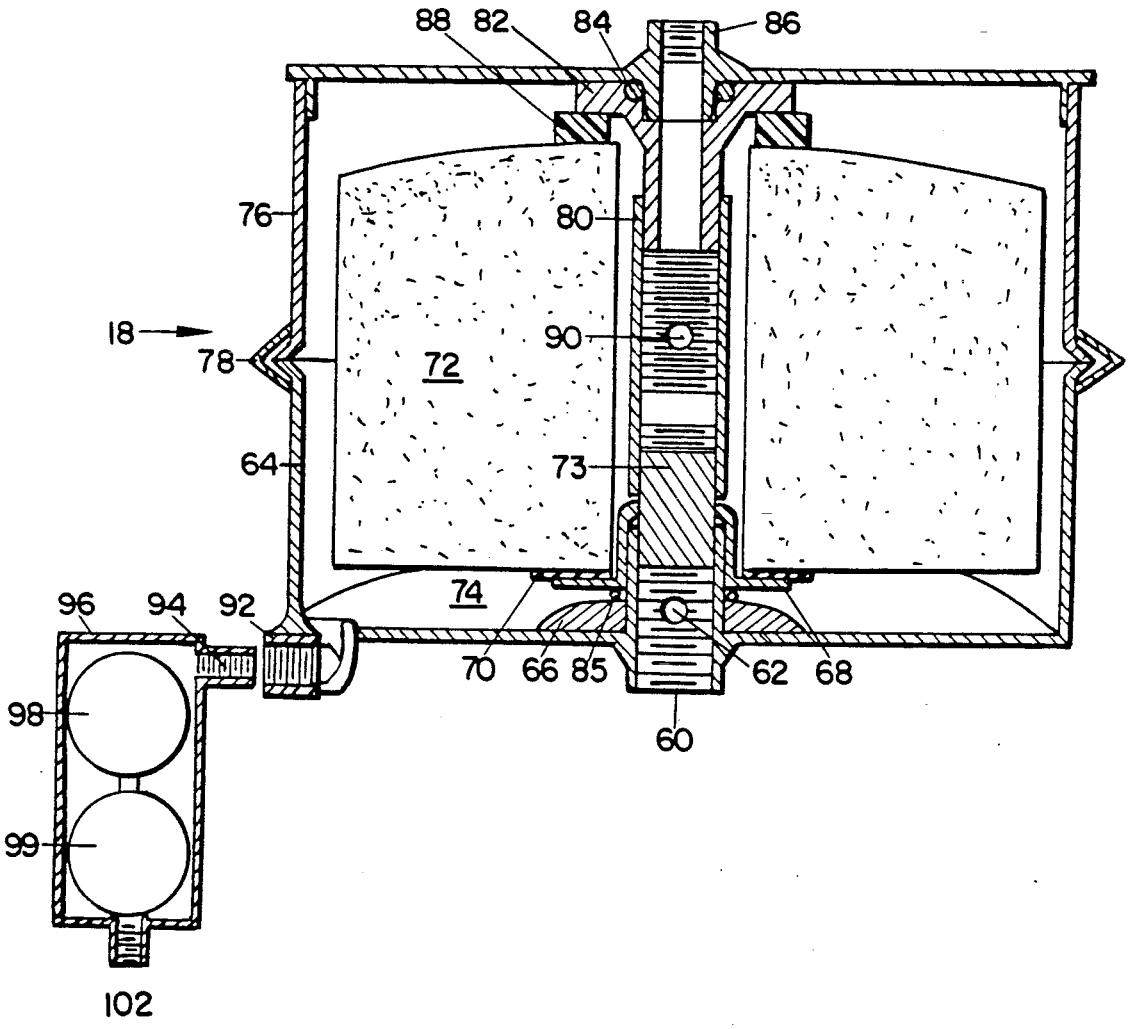
FIG. 2 is a sectional view through the secondary filter assembly of the invention showing its components in assembled position.

FIG. 1 advantageously serves as a flow diagram of the ventilating system of the invention.

Directly connected to each rocker arm 2 is a rocker arm bonnet 4 which contains a sealed set of replaceable multi-stage filters 6, same representing a plurality of layers of filtering material arranged in the order of descending porosity to define a monolithic, layered porous structure. The layers of different permeabilities and porosities are formed by placing the layers of controlled retention characteristics across the interior diameter of rocker arm bonnet 4.

The rocker arm bonnet represents the primary filter stage.

The multilayered primary microfiltration medium consists of a series of filter elements each comprised of reticulated airfoam "honeycomb" material consisting of a three-dimensional network of interconnecting strands of a polyurethane resin. Each element abuts the next in face-to-face confrontation and is longitudinally aligned with the others. Each varies in porosity from a most coarse inboard layer 8 to a layer of finest porosity 12 as the outboard layer in the direction of airflow through the bonnet, with a layer of intermediate porosity 10 sandwiched between layers 8 and 12.

Filters 8, 10, and 12 are interengaged as by a spindle means 14 extendable through the bank of the filters of the set and having a finger engaging portion by which the filters may be removed unisonly from the bonnet for any replacement or cleaning purpose.

An apertured cover 16 is nestably receivable over the open top of rocker arm bonnet 4 to tightly enclose same.

The blow-by vapors are led into the rocker arm bonnet for the primary filtration.

A connecting conduit 60 leads from the bonnet interior and through its cover 16 to the lower extremity of a secondary subassembly now to be described.

The filtered blow-by vapors are passaged from the primary stage to the secondary stage 18 via conduit 60. The conduit extends through a suitable opening in the bottom wall of a lower housing half part or canister 64.

The secondary stage is termed an evaculator. Conduit 60 is provided with a plurality of equispaced raw vapor inlet ports 62. A magnetic disc 66 circumscribes conduit 60 and seats upon the inner wall of the bottom of lower housing half part 64. Inlet ports 62 are disposed upwardly of magnetic disc 66.

Spaced upwardly of magnetic disc 66 and also circumscribing conduit 60 is a baseplate baffle 68 having a lowermost radially extending circular portion upon which seats a filter gasket 70.

A plug 73 seals off the upper extremity of conduit 60 to influence the passage of the incoming fumes and vapors radially over the face of magnetic disc 66 and into the open space 74 between a filter cartridge 72 and lower housing half part 64.

As the vapors enter through the conduit, they are confronted by the baffle serving to direct the vapors over the magnetic disc which picks up the ferrous particles therein contained, with the non-ferrous particles and moisture being subsequently trapped by filter cartridge 72. That is, the ferrous particulates are captured by the magnetic system upon entry into the sealed secondary stage, while the non-ferrous abrasives continue on in a vacuum atmosphere only to be trapped by the filter cartridge.

Filter cartridge 72 seats upon gasket 70 whereby it is spaced upwardly of the bottom flooring or deck of the lower housing half part to define space 74.

An upper housing half part 76 mates with the lower housing half part 64 at the midsection of the housing, the two components being suitably sealed with an annular U-shaped locking ring 78.

Upwardly of conduit 60 and extending vertically through a provided central opening in filter 72 is a core tube 80 having an interior thread and into the lower end of which plug 73 is threadedly engaged and plug welded thereto.

With the upper extremity of core tube 80, a filter retainer 82 is threadedly engaged, same being sealed against the interior of the top wall of the upper housing half part by an O-ring seal 84, strategically positioned between filter retainer 82 and an outlet 86 extending through the top wall of and leading from the upper housing half part.

An annular filter element gasket 88 is interposed between filter retainer 82 and the top of filter 72 to insure against leakage of any of the vapors and fumes except by passage through the filter and core tube 80 and retainer 82 before exiting via the outlet port 86 as filtered vapors.

An O-ring seal 85, additional to O-ring seal 84, in the lower half of the canister aids to insure the prevention of the vapors from escaping secondary filtration.

A crankcase oil return port 92 is provided in the bottom wall of lower housing half part 64 to which a crankcase oil inlet 94 is threadedly connected.

An anti-syphon valve 96 is disposed outboard of crankcase oil inlet 94 and in which an upper float ball 98 and a connected anti-syphon ball 100 are disposed.

The buoyancy of the oil when present in the antisyphon valve 96 lifts the twin balls 98–100 from the seat of the lower float ball on the crankcase oil outlet port 102 so as to allow the return of the crankcase oil to the engine crankcase. This operation takes place only when excess blow-by in engine crankcase is above normal causing a high concentration of oil accumulation of oil in the lower half of the secondary housing.

The remaining filtered fuel and moisture vapors are exited from the secondary stage via outlet 86 and a threadedly connected conduit 100 to a tertiary filter subassembly, as shown in FIG. 1.

Conduit 100 leads into and through a wall 102 of a clear see-through tertiary stage filter housing 104 in which is disposed a filter element 106.

Within the housing and adjacent filter element 106 a free-spinning fan 108 is provided, same being operable rotatively by virtue of a series of small holes 110 in an activator plate 112, the plate 112 and fan 108 being mounted on a shaft 114.

The fan functions as an indicator of the airflow. When and if the fan slows down in its rotative motion, or ceases rotation, the delivered intelligence is to the effect that a change in filters is indicated.

A cover wall 118 permits the enclosing of the third stage filter at its opposite end.

The third stage assembly performs a pair of essential functions; it acts as a flow indicator filter to be sure, but more importantly, it serves as an indicator of the overall system performance.

The housing, being clear, it is possible to see into same to determine the activity of the free-spinning fan blade. Thus, the overall performance of the system can be assessed.

The color of the third stage filter unit is an indicator of the whole system performance. A discolored filter indicates the presence of varnish or soot and that the filter element should be replaced. The free-wheeling fan rate of turning indicates a direct ratio to the engine fume flow and is a good indicator of system performance. The fan free wheeling means that vapors are moving through the system, and the system is functioning satisfactorily.

The output of the third filter assembly connects via a conduit 120 to the vacuum side of a compressor 122 which provides a vacuum sufficient enough to draw the cleaned vapors through the system. The pressure side of the compressor connects via conduit 124 to the intake manifold 126 of the engine.

Thereby, the fuel being introduced from the crankcase, as so called blow-by, has been cleansed by the system and returned to the engine creating increased horsepower for use, thus, better fuel economy.

I claim:

1. Vacuum-controlled apparatus for removing contaminates from fumes and vapors emanating from the crankcase of a diesel engine and for returning the cleansed vapors to the engine combustion chamber and consisting of an in seriatim series of filter stages comprising:

a primary filter stage including
- a rocker arm bonnet fitted to the engine rocker arm and communicating therewith, sand
- a series of layers of filter elements disposed within the bonnet and arranged as a stack of layers in face-to-face confrontation as to each other with the layers differing in porosity from a most coarse inboard layer to a most fine outboard layer with a layer of intermediate porosity sandwiched therebetween, a secondary filter stage including
- a secondary housing,
- a first conduit interconnecting the primary stage filter and the secondary housing into which it is extendable,
- a magnetic disc within the housing and circumscribing the first conduit,
- a seal at the upper extremity of the first conduit for directing the incoming flumes and vapors from the first conduit into the housing and past the magnetic disc for the capture of any ferrous particulates therewith,
- a filter cartridge spaced upwardly of the disc,
- housing seal means for forcing all fumes and vapors through the filter cartridge for the capture of the non-ferrous particulates therewith preliminary to discharge from the secondary housing,
- an apertured core tube disposed centrally of and within the filter cartridge, and
- an outlet in the secondary housing communicating with the core tube for the discharge of the filtered fumes and vapors from the secondary housing, a tertiary filter stage including
- a tertiary housing,
- a second conduit interconnecting the secondary stage outlet and the tertiary housing,
- a filter element disposed within the tertiary housing,
- a fan disposed beneath the filter element, and
- an activator plate disposed beneath the fan, and a compressor having a vacuum side connected to the tertiary housing and a pressure side connected to the engine intake manifold for the forced in seriatim withdrawal of the fumes and vapors from the rocker arm and through the primary and secondary and tertiary filter stages and returnably to the engine intake manifold.

* * * * *